US006793112B2

(12) United States Patent
Ammerman

(10) Patent No.: US 6,793,112 B2
(45) Date of Patent: Sep. 21, 2004

(54) SHOULDER CARRIER WITH LATERALLY MOVEABLE SHOULDER STRAP

(75) Inventor: Jill Greene Ammerman, Beverly Farms, MA (US)

(73) Assignee: Airpacks, Inc., Beverly, MA (US)

( * ) Notice: Subject to any disclaimer, the term of this patent is extended or adjusted under 35 U.S.C. 154(b) by 69 days.

(21) Appl. No.: 10/291,203

(22) Filed: Nov. 8, 2002

(65) Prior Publication Data

US 2004/0089687 A1 May 13, 2004

(51) Int. Cl.[7] ..... A45F 3/02

(52) U.S. Cl. ..... 224/607; 224/257; 224/264; 224/578; 224/608; 224/643; 224/644

(58) Field of Search ..... 224/257, 264, 224/578, 579, 604, 607, 608, 627, 642, 643, 644, 645; 150/110

(56) References Cited

U.S. PATENT DOCUMENTS

| | | | | |
|---|---|---|---|---|
| 900,610 | A | | 10/1908 | Stow |
| 1,444,157 | A | | 2/1923 | Lee |
| 2,210,351 | A | | 8/1940 | Westendorf |
| 2,604,917 | A | | 7/1952 | Reilly |
| 2,608,326 | A | | 8/1952 | Spector |
| 2,672,963 | A | | 3/1954 | Epton |
| 2,676,737 | A | | 4/1954 | Zirbel |
| 3,071,133 | A | | 1/1963 | Eisen |
| 3,254,816 | A | * | 6/1966 | Gray ..... 224/630 |
| 3,462,069 | A | | 8/1969 | Suominen |
| 3,482,761 | A | | 12/1969 | Suominen et al. |
| 3,500,973 | A | | 3/1970 | Bush |
| 3,521,623 | A | | 7/1970 | Nichols et al. |
| 3,665,551 | A | | 5/1972 | Ender |
| 3,667,457 | A | | 6/1972 | Zumaglini |
| 3,679,108 | A | | 7/1972 | Ingram |
| 3,753,824 | A | | 8/1973 | Bosse |
| 3,799,413 | A | | 3/1974 | McBain |
| 3,818,962 | A | | 6/1974 | Muller-Scherak |
| 3,883,053 | A | | 5/1975 | Prichard et al. |
| 3,902,640 | A | | 9/1975 | Geiben |
| 3,957,282 | A | | 5/1976 | Finnigan |
| 3,994,372 | A | | 11/1976 | Geller et al. |
| 4,135,503 | A | | 1/1979 | Romano |
| 4,176,722 | A | | 12/1979 | Wetmore et al. |
| 4,384,602 | A | | 5/1983 | Ores |
| 4,500,019 | A | | 2/1985 | Curley, Jr. |

(List continued on next page.)

FOREIGN PATENT DOCUMENTS

| | | | | |
|---|---|---|---|---|
| FR | 2706263 A3 | * | 12/1994 | ..... 224/153 |
| WO | WO-99/58018 A1 | * | 11/1999 | |

OTHER PUBLICATIONS

International Search Report for PCT/US03/35755, dated Apr. 22, 2004.

*Primary Examiner*—Gary E. Elkins
(74) *Attorney, Agent, or Firm*—Wolf, Greenfield & Sacks, P.C.

(57) ABSTRACT

A shoulder carrier having at least one shoulder strap connected to a container. A connection point between the shoulder strap and the container may be moved laterally without disconnecting the strap from the container.

24 Claims, 3 Drawing Sheets

U.S. PATENT DOCUMENTS 4,550,869 A 11/1985 Johnson
4,559,933 A 12/1985 Batard et al.
4,573,202 A 2/1986 Lee
4,681,113 A 7/1987 Coplans
4,682,587 A 7/1987 Curlee
4,682,588 A 7/1987 Curlee
4,739,913 A 4/1988 Moore
4,744,398 A 5/1988 Clark
D298,386 S 11/1988 Hirahara
4,789,202 A 12/1988 Alter
4,826,060 A 5/1989 Hollingsworth
D302,748 S 8/1989 Dubeck et al.
4,852,778 A 8/1989 Beiser et al.
4,887,318 A 12/1989 Weinreb
4,948,023 A 8/1990 Tripp
4,978,044 A 12/1990 Silver
4,986,805 A 1/1991 Laramore
4,989,656 A 2/1991 Derfler
4,993,409 A 2/1991 Grim
5,012,964 A 5/1991 Falletta et al.
5,016,620 A 5/1991 Matthews
5,042,704 A * 8/1991 Izzo ..... 224/643
5,062,414 A 11/1991 Grim
5,072,727 A 12/1991 Aronne
5,195,948 A 3/1993 Hill et al.
5,203,482 A 4/1993 Puff
5,205,814 A 4/1993 Lundrigan et al.
5,228,609 A 7/1993 Gregory
5,249,890 A 10/1993 Bergstrom
5,297,304 A 3/1994 O'Sullivan
5,348,155 A 9/1994 Isiwa
5,349,706 A 9/1994 Keer
5,361,957 A 11/1994 Weintraub
5,378,224 A 1/1995 Billotti
5,396,906 A 3/1995 Harrold
D357,583 S 4/1995 Bauman
5,415,332 A 5/1995 Kliot
5,419,473 A 5/1995 Lamar
5,429,288 A 7/1995 Sattler
5,435,647 A 7/1995 Oliver
5,437,615 A 8/1995 Pekar et al.
5,507,422 A 4/1996 Shields
5,526,969 A 6/1996 Greenberger
5,529,229 A 6/1996 Fier
5,547,461 A 8/1996 Levis
5,551,614 A 9/1996 Ham
5,566,871 A 10/1996 Weintraub
5,577,652 A * 11/1996 Cooper ..... 224/578
5,632,429 A 5/1997 Cantwell
5,797,529 A * 8/1998 Lavine ..... 224/575
5,884,737 A 3/1999 Cabo
5,894,977 A 4/1999 Krueger et al.
5,927,581 A * 7/1999 Reddy et al. ..... 224/578
6,003,744 A 12/1999 Culjak
6,109,495 A 8/2000 Hernandez
6,131,783 A 10/2000 Maeng
6,138,881 A * 10/2000 Paul et al. ..... 224/578
6,152,343 A * 11/2000 Shin ..... 224/264
6,164,509 A 12/2000 Gausling et al.
6,173,874 B1 * 1/2001 Stein et al. ..... 224/645
6,257,472 B1 7/2001 Freedman
6,331,170 B1 * 12/2001 Ordway ..... 602/19

* cited by examiner

SHOULDER CARRIER WITH LATERALLY MOVEABLE SHOULDER STRAP

FIELD OF THE INVENTION

The invention relates to shoulder carriers having a movable shoulder strap.

BACKGROUND OF THE INVENTION

Shoulder carriers, such as backpacks, golf bags, garment bags, mail-carrier bags, etc., are widely used and are available in a variety of different special-use and general purpose configurations. For example, backpacks are available for carrying small children, for carrying relatively large amounts of weight for extended hiking or cold-weather travel, for carrying schoolbooks, etc. Several such examples are shown in U.S. Pat. Nos. 3,679,108; 3,902,640; 4,384,602; 5,526,969; 5,529,229; and 5,547,461.

SUMMARY OF THE INVENTION

The invention provides a shoulder carrier having at least one shoulder strap connected to a container. In one aspect of the invention, the shoulder strap may be adjusted in lateral position on the container without disconnecting the strap from the container. For example, a lower end of the shoulder strap may be secured to a container so that the connection point between the lower end and the container may be moved from one side of the container to the other. Such adjustment may allow a backpack to have only one shoulder strap, yet allow the backpack to be worn with the shoulder strap on either the left or right shoulder. In one illustrative embodiment, the shoulder strap may be mounted so that it can freely slide from one lateral side to the other in response to the backpack being borne on a shoulder. Thus, the wearer need not take any specific action to move the strap. Instead, the strap may move automatically to a more appropriate position to allow the carrier to be comfortably worn.

In one aspect of the invention, a shoulder carrier includes a container into which items to be carried can be placed. At least one shoulder strap having upper and lower ends is secured to the container, with the lower end being mounted to the container so that a connection point between the lower end and the container is movable between lateral positions without disconnecting the lower end from the container.

In one aspect of the invention, a shoulder carrier includes a container in which to carry at least one item. An anchor is mounted to the container with the anchor generally extending laterally across the back of the container. A coupling is mounted to the anchor so the coupling is movable along a length of the anchor, and at least one shoulder strap has an upper end attached to the container and a lower end secured to the coupling.

In one aspect of the invention, the coupling may move freely along the anchor, or the coupling and/or anchor may be provided with locking or friction devices to help keep the coupling from moving relative to the anchor unless a locking device is unlocked or some other action is taken by a wearer.

In one aspect of the invention, a shoulder carrier may include a lumbar support so that weight of items in the container, as well as of the carrier itself, can be borne on a wearer's shoulders as well as on the hip or lumbar region of the wearer's back without using a hip belt. Weight of the carrier may be transferred to the wearer's hip or lumbar region, at least in part, by the lumbar support. Weight transfer may be achieved by the lumbar support resting on the wearer's hip or lumbar region using features of the invention, thus transferring weight away from the shoulder and making the carrier seem lighter to the wearer. Weight transfer may be enhanced by the way in which a shoulder strap is attached to the carrier container. As used herein, the term shoulder carrier refers to any device for carrying weight that includes at least one shoulder strap to transfer weight of a carrier to a shoulder of the wearer. Examples of a shoulder carrier are a garment bag, mail-carrier bag, golf bag, backpack, briefcase, purse, etc. The term lumbar support refers to a resilient portion of the shoulder carrier that can be used to contact and transfer weight of the carrier to a wearer's lumbar region of the back or hips. Thus, the term lumbar support does not preclude an arrangement in which weight of the shoulder carrier is transferred only to a wearer's hip, and not the lumbar region of the wearer's back.

In one aspect of the invention, the shoulder carrier is a single strap carrying bag with a lumbar support. Thus, unlike conventional bags having only a single shoulder strap, the single strap shoulder carrier according to this aspect of the invention allows weight of the bag to be transferred to a wearer's hip or lumbar region of the back in addition to the wearer's shoulder.

In one aspect of the invention, the lumbar support may include an inflatable bladder.

In one aspect of the invention, the shoulder strap includes a pad to more comfortably and resiliently distribute force of the shoulder strap to the wearer's shoulder. The pad can include an inflatable bladder and may have several compartments having a roughly rectangular pillow shape, e.g., to facilitate bending of the strap to conform to a wearer's shoulder without kinking.

In one aspect of the invention, a shoulder strap pad is slidably attached to the shoulder strap.

In one aspect of the invention, the shoulder carrier includes a shoulder pad that has a fluid-filled bladder. The lumbar support also includes a fluid-filled bladder. The shoulder strap may have a lower end that is mounted to the container so that it may move between different lateral positions on the container without being detached from the container.

The invention also provides a method for positioning a shoulder carrier on a wearer. A shoulder carrier having at least one shoulder strap is positioned so that a lumbar support of the carrier contacts a lumbar area or hip area of the wearer. The shoulder strap may be adjusted from one lateral position to another without being disconnected from the container.

Various other features and advantages of the invention will be apparent and/or obvious from the following detailed description, which should be read in conjunction with the accompanying drawings and claims.

BRIEF DESCRIPTION OF THE DRAWINGS

The invention is described with reference to the following drawings, in which like reference numerals refer to like elements, and wherein.

DETAILED DESCRIPTION

Aspects of the invention are described below in connection with illustrative embodiments. However, it should be understood that the invention is not limited to these embodiments. For example, the invention could be used with golf bags, mail-carrier bags, baby carriers, etc. Therefore, the term shoulder carrier refers to any apparatus used to carry weight in which at least some of the weight is supported by a wearer's shoulder.

Figure 1:
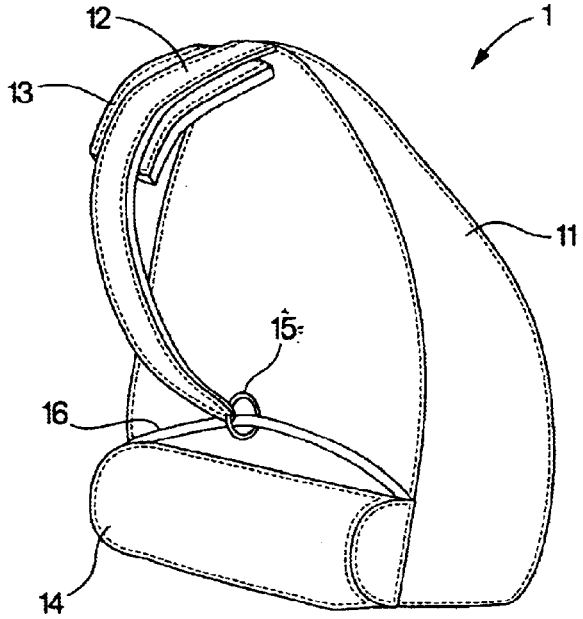
FIG. 1 shows a perspective side view of a shoulder carrier in an illustrative embodiment in accordance with the invention.

FIG. 1 shows a shoulder carrier 1 in the form of a single strap backpack. In this illustrative embodiment, the shoulder carrier 1 includes a container 1, which can be used for carrying various items such as books, clothes, tools, etc. The container 11 can be made of a flexible material, such as a nylon or other polymer fabric and/or include stiffening elements to help define the shape of the container 11. For example, the container 11 could include a molded plastic insert that is placed inside of a flexible fabric bag to give the container 11 a more defined shape. The container 11 also could have selected portions that are made more rigid than other portions of the container 11. For example, a bottom portion of the container 11 could be made more stiff than other portions of the container 11 to give the container 11 a more defined bottom section. Portions of the container 11 can be made more stiff by attaching stiffening elements, such as plastic rods, resilient foam pads, or other items to a flexible fabric shell. Of course, the container 11 could be made entirely of a flexible material, such as a conventional duffel bag, or the container 11 could be made entirely of a rigid material, such as a molded plastic suitcase or insulated cooler. In short, the container 11 can be formed in any of the various well-known ways for producing carrying bags or containers, may have any suitable size or shape, and/or may have any suitable means for allowing entry into the container (such as flaps, zippers, hook-and-loop fasteners, a hinged lid, etc.).

The shoulder carrier 1 also includes a shoulder strap 12 that is secured to the container 11 and transfers at least some of the weight in the container 11 to a shoulder of the wearer. The strap 12 is preferably made of a flexible material, such as leather or a polymer fabric and may have a width of one inch or more to help distribute weight more evenly on the wearer's shoulder. However, the shoulder strap 12 could be made of any desired material and in any width or cross section provided that the shoulder strap 12 can provide desired weight supporting characteristics. The shoulder strap 12 can be made to resist stretching or other lengthening of the shoulder strap 12 in response to static or dynamic loads on the strap 12. Alternately, the strap 12 could include elements or be made of a material that stretches when the strap 12 is subjected to static or dynamic loads. Stretching of the strap 12 or elements within the strap 12 could reduce dynamic loads on a wearer's shoulder such as when the wearer runs while wearing the shoulder carrier 1. The shoulder strap 12 can also include a length adjusting element so that the length of the strap 12 can be adjusted, as is well-known in the art. Such adjusting elements are well known in the art and can include friction-type adjusters, buckles, hook-and-loop connectors (VELCRO™), etc.

In this illustrative embodiment, a lower end of the strap 12 is mounted to the container 11 so that a connection point between the lower end of the strap 12 and the container 11 may be laterally adjusted in position. In this embodiment, the lower end of the strap 12 is mounted to the container via a coupling 15 and an anchor 16, although any suitable arrangement that allows for lateral adjustment of the strap connection point may be used. As used herein, "connection point" refers to a lateral position at which the lower end of the strap 12 may effectively exert a supporting force on the container 11, such as the position where the coupling 15 contacts the anchor 16. That is, although the anchor 16 in FIG. 1 is attached to the container 11 at opposite lateral ends, the point at which the strap 12 effectively exerts force on the container 11 (the connection point) is the position at which the coupling 15 contacts the anchor 16. The "lower end" of the strap 12 is the end that is positioned below the opposite end (upper end) of the strap attached to the container 11 when the carrier 1 is worn.

Figure 2:
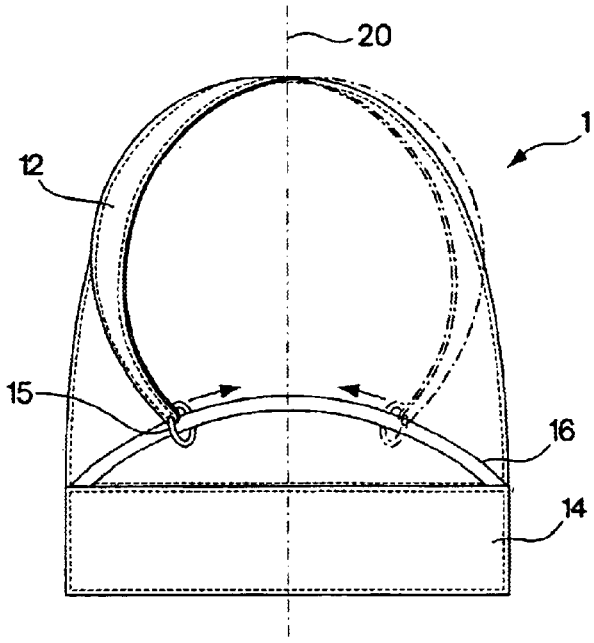
FIG. 2 shows a rear view of the FIG. 1 shoulder carrier with a shoulder strap positioned at two different lateral positions.
Figure 3:
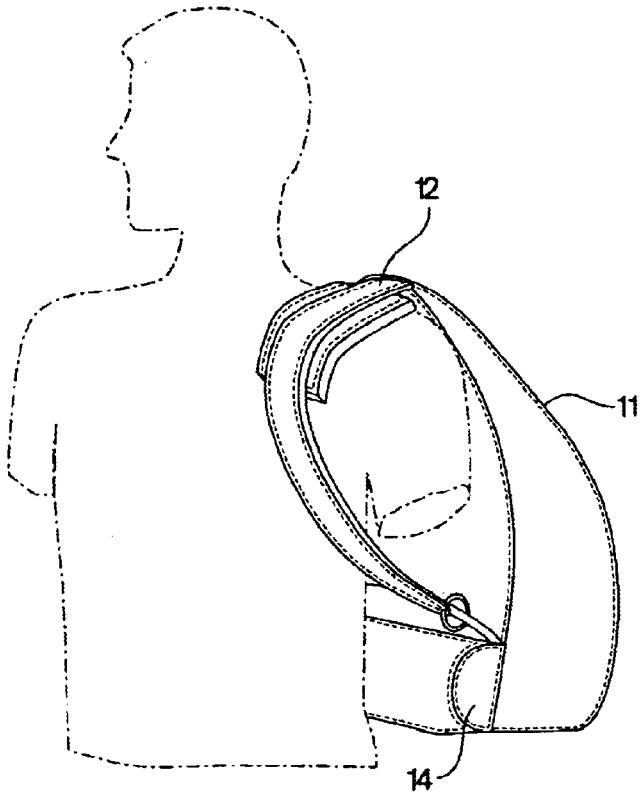
FIG. 3 shows the FIG. 1 shoulder carrier being worn.

In accordance with one aspect of the invention, this mounting arrangement may allow the lower end of the strap 12 to be moved from one lateral position on the container 11 to another lateral position. For example, FIG. 2 shows the lower end of the strap 12 located at left and right side lateral positions relative to the container's midline 20. Such movement may allow the shoulder carrier 1 to be worn on either the left shoulder as shown in FIG. 3, or the right shoulder (not shown) while the strap 12 slides laterally to position the container on the wearer's back regardless of which shoulder the carrier is worn on. Thus, a portion of the shoulder carrier's weight may rest on, i.e., be supported by, the back or lumbar area of the wearer. When the shoulder carrier 1 is worn on the left shoulder as shown in FIG. 3, the shoulder strap 12 may be positioned at the right lateral side as shown in dashed line in FIG. 2. When the carrier 1 is moved from the left shoulder to the right, the lower end of the strap 12 may move to the left side lateral position shown in solid line in FIG. 2. As a result, the shoulder carrier 1 may have only one shoulder strap 12, yet allow the carrier 1 to be worn on either shoulder with the container 11 positioned at the wearer's back. Although not shown in FIG. 3, the shoulder carrier 1 may be worn with the strap 12 over the wearer's head so that the strap 12 runs diagonally across the wearer's chest, e.g., from the wearer's right shoulder to the wearer's left side or hip area or vice versa. If the carrier 1 is intended to be worn with the strap 12 over the wearer's head, the carrier 1 may be provided with an underarm strap(s) like that found in bicycle messenger bags to help keep the container 11 in place on the wearer's back.

The lower end of the strap 12 need not be adjustable between extreme left and right side lateral positions as shown in FIG. 2. Instead, the connection point for the lower end of the strap 12 may be adjustable laterally over a shorter range. In one aspect of the invention, the lower end may be moved laterally from a position on one side of the midline 20 of the container 11 to a position on the other side of the midline 20 to accommodate wearing of the carrier on left and right shoulders using the same strap 12. However, in other embodiments, the connection point for the lower end may be laterally movable between positions on only one side of the midline 20, e.g., where two shoulder straps are used and both have lower ends that are mounted to separate anchors and are laterally movable relative to the container 11.

The strap 12 may be mounted to freely move laterally as shown, or may be mounted so that some action or manipulation by the wearer is required to move the strap laterally.

For example, the coupling 15 and/or anchor 16 may have a lock that keeps the coupling 15 in position on the anchor 16 unless unlocked for movement along the anchor 16. This feature may allow a wearer to maintain the strap 12 in a desired position, e.g., to ensure that the strap 12 is in the desired position the next time the carrier 1 is worn.

Figure 4:
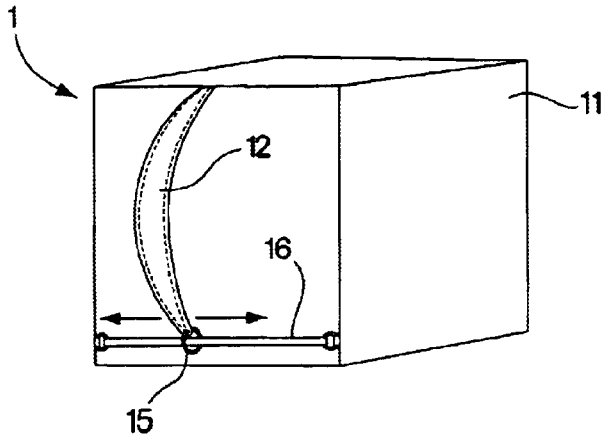
FIG. 4 is a rear perspective view of another illustrative embodiment of a shoulder carrier in accordance with the invention.
Figure 5:
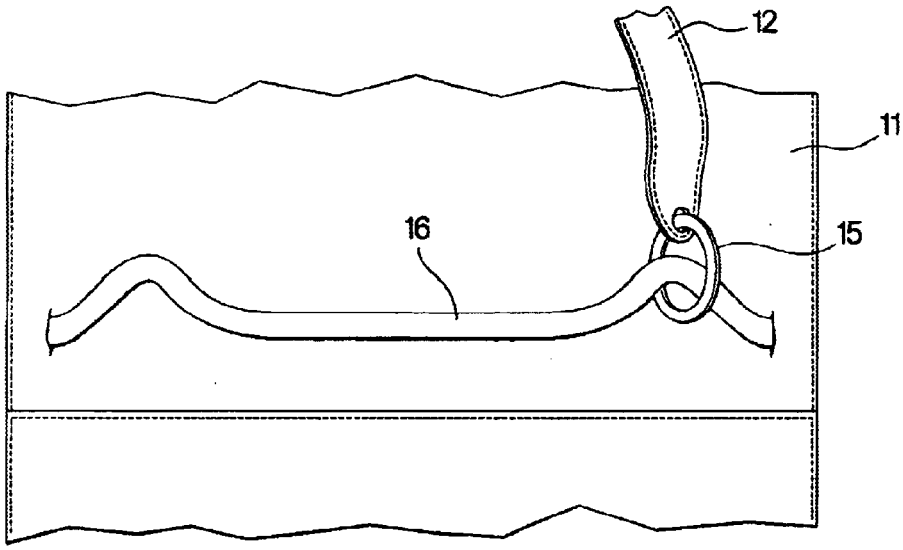
FIG. 5 shows a partial rear view of a shoulder carrier in another illustrative embodiment in accordance with the invention.

The anchor 16 may be formed in any suitable way and have any suitable shape. For example, the anchor 16 may be formed as a stiff rope, a braided wire, a metal or plastic rod, a track with a channel in which the coupling moves or other device that is secured to the container. When the anchor 16 includes a rod-shaped member, the anchor 16 may have a smooth outer surface to allow easy movement of the coupling 15, or may have a rough or toothed outer surface to help prevent sliding of the coupling 15, particularly when the strap 12 is under load. Preferably, the anchor 16 is made strong enough to support loads carried in the container 11, but the anchor 16 may be made flexible, e.g., so the anchor 16 can absorb shocks or other dynamic loads. The anchor 16 may have an upward curve, as shown in FIG. 2, be straight as shown in the embodiment of FIG. 4, or have any other suitable shape. For example, the anchor 16 may have recessed or bent portions that function to catch the coupling 15 at a particular position as shown in FIG. 5. The anchor 16 may be secured to the container 11 in any suitable way, such as by brackets, welding, stitching, rivets, etc. Alternately, the anchor 16 may be formed unitarily with at least a portion of the container 11, e.g., when the container 11 includes a molded plastic portion, the anchor 16 may be molded as part of the container 11. Thus, the anchor 16 need not be spaced from the back of the container 11, but instead may be formed as part of the back of the container 11. The anchor 16 need not extend across the entire lateral width of the container 11, but instead may extend laterally across a portion of the container 11. As used herein, "extending across the container" or "extending across the back of the container" is intended to include extension across the entire back of the container as well as extension across a portion of the back of the container. Moreover, two or more anchors 16 may be provided, e.g., one anchor 16 on either side of the container midline 20 for each of two shoulder straps.

Like the anchor 16, the coupling 15 may have any suitable shape, size or configuration. The coupling 15 may be a metal or plastic loop as shown, or may be a portion of the strap 12 that is looped around the anchor 16. If the anchor 16 includes a groove or channel, the coupling 15 may have a T-nut, ball or other shape that engages with the channel and prevents the disconnection of the lower end of the strap from the container, but allows the coupling 15 to move laterally along the anchor 16. Other suitable arrangements in which the coupling 15 can move along the anchor 16 may be used.

Some backpacks and other bags allow a shoulder strap to be moved laterally on a container, i.e., by unclipping the strap at a first connection point and reconnecting the strap at a second connection point. Therefore, these arrangements require that the lower end of the strap be disconnected from the container for movement, making adjustment of the position of the strap while the shoulder carrier is being worn difficult or impossible. In contrast, aspects of the invention allow the strap 12 to be moved laterally on the container 11 without disconnecting the lower end of the strap 12 from the container 11. Accordingly, in one aspect of the invention, a strap connection point may be adjusted in lateral position on a shoulder carrier without the strap being disconnected from the container. This feature may allow, for example, a wearer to adjust the position of the strap while the shoulder carrier is being carried by the shoulder strap.

As will be understood by those of skill in the art, the shoulder carrier 1 may include other suitable features. For example, as shown in FIG. 1, a pad 13 may be provided with the strap 12. The pad 13 may be positioned between the strap 12 and the wearer's shoulder, or the pad 13 may be made integral with the strap 12, e.g., so that a cushioning element is positioned inside of the strap 12. The pad 13 can be made of any type of material to distribute the force of the strap 12 on the wearer's shoulder. For example, the pad 13 could include a resilient foam element or a fluid-filled bladder. A fluid-filled bladder may be filled with air and/or a gel, and the bladder may optionally be compartmented. Compartments in the bladder may be arranged so that if one compartment is punctured or otherwise compromised, the other compartments may remain intact and functional. The pad 13 may also include other optional features. For example, the pad 13 may be attached to the shoulder strap so that the pad 13 slides freely along the strap 12. Thus, once the pad 13 is in place on a wearer's shoulder, the pad 13 can anchor in place when the container 11 is moved, e.g., from a wearer's hip to the wearer's back. This feature can reduce or eliminate abrasion of the strap 12 on the wearer's shoulder as the container 11 moves. In addition, the pad 13 could function to reduce dynamic loads on the wearer's shoulder. For example, a fluid-filled bladder may dynamically compress and expand as dynamic loads are placed on the strap 12. This action of the bladder can absorb some of the dynamic energy like a shock absorber and increase the wearer's comfort.

As also shown in FIG. 1, the shoulder carrier 1 may include a lumbar support 14. The lumbar support 14 may contribute to the comfort of the wearer in a variety of ways. For example, the support 14 may transfer some of the weight of the shoulder carrier 1 to the hip or lumbar region of the wearer's back. Therefore, not all of the weight of the carrier 1 need necessarily be borne on the shoulder of the wearer. The support 14 may transfer weight of the carrier 1 by contacting, or resting on, a portion of the wearer's hip or back that curves outward.

The lumbar support 14 may provide additional features. For example, the support 14 may separate the container 11 from the wearer so that the container 11 can be held somewhat away from the wearer. For example, the lumbar support 14 may project from the back portion of the container 11 by 1–3 inches or more. When the wearer moves, since the container 11 is positioned away from the wearer, the container 11 can be prevented from contacting the wearer, such as the wearer's lower hip or leg area. Spacing the container 11 somewhat from the wearer may also facilitate lateral movement of the strap 12. The lumbar support 14 may also prevent movement of the container 11 relative to the wearer as the wearer moves because the support 14 can deform to the contour of the wearer's hip, enabling the lumbar support 14 to contact a broad area of the hip. This broad area of contact can enhance the amount of weight supported by the wearer's hip as well prevent sway or other movement of the container 11 as the wearer moves. The lumbar support 14 may also insulate the wearer from hard portions of the container 11 itself or sharp objects in the container 11.

The lumbar support 14 can be made of or include various materials. For example, the lumbar support 14 can be made of or include a resilient foam or a fluid-filled bladder. Preferably, the support 14 includes a fluid-filled bladder that is inflated with air. Since the support 14 can be inflated with air, the support 14 can be filled with varying amounts of air depending on the application. One or more valves can be provided to adjust the amount of air in the bladder. For example, women tend to have a broader hip area than men and therefore require somewhat higher inflation of the bladder.

A fluid-filled bladder, such as an air bladder, or other material may be inserted into a pouch formed in or on the back portion of the container 11 to form the lumbar support 14. That is, a pouch could be sewn into or otherwise formed in the back portion and the fluid-filled bladder inserted through an access to form the support 14. The access can simply be a hole or other opening in the lumbar support 14 pouch. The access can be made closeable, for example by providing a hook-and-loop closing element, a zipper, a snap closure, etc. Although the lumbar support 14 preferably includes a fluid-filled bladder, the lumbar support 14 can also include a resilient foam or other material.

The lumbar support 14 need not be formed in the back portion of the container 11, but instead could be removably attached to the back portion. For example, the lumbar support 14 could be attached to the back portion by hook-and-loop fasteners, by a zipper fastener, etc. Thus, the lumbar support 14 could be removed if desired, e.g., to allow the shoulder carrier 1 to be placed in a relatively small space, such as an airplane overhead bin. In some embodiments, the shoulder strap 12, pad 13, lumbar support 14 and other features of the carrier 1 may be arranged as disclosed in U.S. Pat. No. 6,471,105, hereby incorporated by reference in its entirety.

FIG. 4 is a rear view of a shoulder carrier 1 in another illustrative embodiment. In this illustrative embodiment, the container 11 has a box-like shape and may be formed from a woven nylon fabric, as a solid molded plastic case, or any other suitable arrangement. Of course, other materials can be used to form the container 11, as is well known in the art. This embodiment is similar to that shown in FIG. 1, except that the carrier 1 in FIG. 4 does not include a lumbar support 14. Instead, an anchor 16 is positioned near a bottom of the container 11 and extends across the back of the container in a lateral direction. Thus, although a lumbar support 14 is included in some aspects of the invention, a lumbar support 14 is not required.

Although the embodiments above are shown with one shoulder strap 12, a shoulder carrier in accordance with the invention may be provided with two or more shoulder straps, or a shoulder strap may be made to split into two straps, if desired. For example, a single shoulder strap may have two separate parts that are connected by a zipper, hook-and-loop fastener, or other so that the two parts may be separated and each used as shoulder straps like that in a conventional two strap backpack. Each strap portion may be mounted to the anchor by a respective coupling so that the strap portions may move laterally. With such a modification, the shoulder carrier may be worn either as a single strap bag, or in a standard backpack style.

Figure 6:
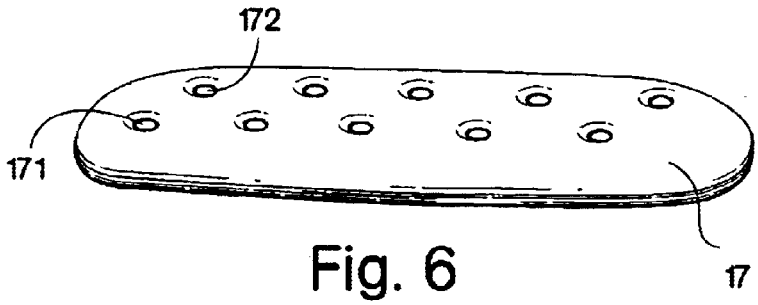
FIG. 6 is a perspective view of a bladder for a shoulder pad.

FIG. 6 shows an inflatable bladder 17 that may be used in the shoulder pad 13. In this illustrative embodiment, the bladder 17 is compartmented so that a plurality of approximately pillow-shaped compartments communicate with each other. Thus, the bladder 17 can be inflated using a single valve or opening in the bladder 17. The bladder 17 can be made from a thermoplastic material (e.g., two heat sealed or otherwise welded sheets of plastic material), and can be elastic. In this embodiment, two sheets of plastic material are welded together around a periphery 171. The compartments may be formed by welding the two sheets together at staggered positions 172. The pad 13 can have any suitable thickness, width and/or length, e.g., ½2 inches thick, 2–4 inches wide and 6–15 inches long. Of course, it should be understood that the bladder 17 may have any desired configuration or dimensions. For example, the compartments in the bladder 17 can be isolated from each other. This arrangement may be advantageous if, for example, one of the compartments is punctured. In this case, only the one compartment would fail, but other compartments would continue to operate. The compartments in the bladder 17 may also help the pad 13 to conform to a wearer's shoulder without buckling.

Figure 7:
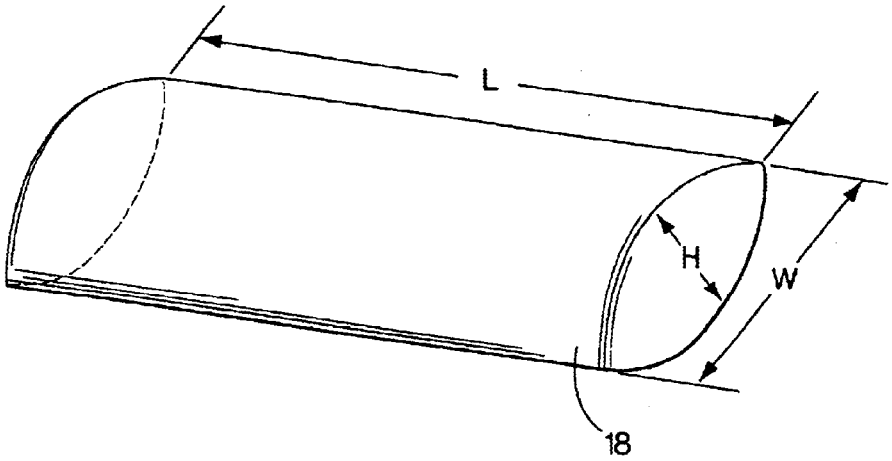
FIG. 7 is a perspective view of a bladder for a lumbar support.

FIG. 7 shows a support bladder 18 that can be used for the lumbar support 14. Similar to the bladder 17, the support bladder 18 can be made of a thermoplastic material and can be filled with a fluid, such as air, a gel, etc. One or more valves can be provided to allow a wearer to adjust the amount of fluid in the bladder 18, and the bladder 18 can optionally be compartmented so that the bladder 18 can still function at some level even if one or more compartments are punctured. In a preferred embodiment, the bladder 18 has a height h of 1–3 inches, a width w of 3–5 inches, and a length L of 6–15 inches. Of course, the dimensions and/or shape of the support bladder 18 can be varied as desired. The bladder 18 can also be formed to conform with a wearer's body.

Although the invention is described in connection with the embodiments above, various alterations, modifications and improvements will occur to those skilled in the art. Such alterations, modifications and improvements are intended to be within the spirit and scope of the invention. Accordingly, the foregoing description is by way of example only, and is not intended to be limiting.

What is claimed is:

1. A shoulder carrier comprising:

a container into which items to be carried can be placed, the container having a back; and at least one shoulder strap having upper and lower ends secured to the container, the lower end being mounted to the container so that a connection point between the lower end and the container is movable between lateral positions without disconnecting the lower end from the container;

wherein the connection point between the lower end and the container is movable between one lateral side of the container and an opposite lateral side of the container.

2. The carrier of claim 1, further comprising an anchor mounted to the container that extends laterally across the container, the lower end of the at least one shoulder strap being mounted to the anchor so that the lower end is movable on the anchor.

3. The carrier of claim 2, further comprising a coupling mounted to the lower end of the at least one shoulder strap, the coupling mounted to the anchor so that the coupling may slide along the anchor to adjust the connection point between the lower end of the at least one strap and the container.

4. The carrier of claim 1, wherein the connection point is adjustable between positions on opposite sides of a midline of the container.

5. The carrier of claim 1, further comprising a shoulder pad with a fluid-filled bladder.

6. The carrier of claim 5, wherein the shoulder pad is positioned inside the at least one shoulder strap.

7. The carrier of claim 1, further comprising:

a lumbar support that bears on a wearer's hip or lumbar region to transfer weight in the container to the hip or lumbar region.

8. The carrier of claim 7, wherein the lumbar support includes a fluid-filled bladder.

9. The container of claim 8, wherein the lumbar support includes a convex portion that projects from the back of the container and the lumbar support extends across the back of the container.

10. The carrier of claim 8, wherein the lumbar support has an approximately cylindrical shape.

11. The carrier of claim 7, further comprising an anchor that extends laterally across the container above the lumbar support, the lower end of the at least one shoulder strap being mounted to the anchor so that the lower end is movable laterally along the anchor.

12. A shoulder carrier comprising:

a container in which to carry at least one item, the container having a back;

an anchor mounted to the container, the anchor generally extending laterally across the back of the container;

a coupling mounted to the anchor so the coupling is movable laterally along the anchor; and at least one shoulder strap having an upper end attached to the container and a lower end secured to the coupling;

wherein the coupling is adjustable between positions on opposite sides of a midline of the container.

13. The carrier of claim 12, wherein the anchor includes a rod-shaped member and the coupling includes a loop element that slides along the rod-shaped member.

14. The carrier of claim 12, further comprising a shoulder pad with a fluid-filled bladder.

15. The carrier of claim 14, wherein the shoulder pad is freely slidable along the shoulder strap.

16. The carrier of claim 14, wherein the shoulder pad is positioned inside the at least one shoulder strap.

17. The carrier of claim 12, further comprising:

lumbar support that bears on a wearer's hip or lumbar region to transfer weight in the container to the hip or lumbar region.

18. The carrier of claim 17, wherein the lumbar support includes a fluid-filled bladder.

19. The container of claim 17, wherein the lumbar support includes a convex portion that projects from the back of the container and the lumbar support extends across the back of the container.

20. The carrier of claim 17, wherein the lumbar support has an approximately cylindrical shape.

21. The carrier of claim 17, wherein the anchor is positioned above the lumbar support.

22. The carrier of claim 12, wherein the anchor has at least one portion to catch the coupling at a position on the anchor.

23. The carrier of claim 12, wherein the anchor has a substantially straight portion that engages with the coupling.

24. A shoulder carrier comprising:

a container in which to carry at least one item, the container having a back;

an anchor mounted to the container, the anchor generally extending laterally across the back of the container;

a coupling mounted to the anchor so the coupling is movable laterally along the anchor; and at least one shoulder strap having an upper end attached to the container and a lower end secured to the coupling;

wherein the coupling is movable between one lateral side of the container and an opposite lateral side of the container.

* * * * *